US008444288B1

(12) United States Patent
Leal

(10) Patent No.: US 8,444,288 B1
(45) Date of Patent: May 21, 2013

(54) CHARGER PLATE HAVING ILLUMINATED MEMBERS

(76) Inventor: Margo Leal, San Jose, CA (US)

( * ) Notice: Subject to any disclaimer, the term of this patent is extended or adjusted under 35 U.S.C. 154(b) by 649 days.

(21) Appl. No.: 12/699,762

(22) Filed: Feb. 3, 2010

(51) Int. Cl.
*F21V 33/00* (2006.01)

(52) U.S. Cl.
USPC ..... 362/157; 362/394; 362/396; 362/101; 220/574

(58) Field of Classification Search
USPC ..... 362/154, 101, 394, 398; 220/574, 220/574.3; 40/442, 452, 421; 239/16–18
See application file for complete search history.

(56) References Cited

U.S. PATENT DOCUMENTS 3,705,982 A * 12/1972 Smolinski ..... 362/154
4,803,604 A * 2/1989 Nichols et al. ..... 362/154
5,355,289 A * 10/1994 Krenn ..... 362/253
5,430,628 A * 7/1995 Saunders ..... 362/253
6,152,575 A * 11/2000 Montanino ..... 362/183
6,335,691 B1 * 1/2002 Bird ..... 340/691.1
6,464,222 B1 * 10/2002 Parker ..... 273/236
7,163,311 B2 * 1/2007 Kramer ..... 362/154
2006/0087831 A1 * 4/2006 Kramer ..... 362/101
2008/0019122 A1 * 1/2008 Kramer ..... 362/154
2012/0106123 A1 * 5/2012 Treurniet ..... 362/20

* cited by examiner

*Primary Examiner* — Ali Alavi

(57) ABSTRACT

A charger plate having illuminated members. The charger plate includes a base, a raised portion, a rim and a circuit. The base is positioned substantially at a center of the charger plate and includes a first plurality of light emitting sources (LES) that outputs light from the base. The raised portion is substantially opaque and circumferentially surrounds the base. The rim circumferentially surrounds the raised portion and includes a second plurality of LES that outputs light from the rim. The circuit may independently control color and brightness associated with the first plurality of LES and the second plurality of LES. The base may include a reflective portion operable to reflect light from the first plurality of LES. The base and the rim may include a light pipe each for distributing the light emitted from their respective LES. The circuit may be powered via power inductive magnets instead of a battery.

20 Claims, 6 Drawing Sheets

500

CHARGER PLATE HAVING ILLUMINATED MEMBERS

TECHNICAL FIELD

The embodiments of the present invention relate to decorative charger plates.

BACKGROUND ART

In recent years, dining has become more than just food. For example, the ambience, the lighting, the food decoration, the music, the color coordination, etc., have become indispensable elements of most high-end establishments. To that end, the use of charger plates has increased for decorative purposes in order to improve aesthetic value and visual appeal.

For example, charger plates are often used to decorate dinner tables at parties, weddings and other events. Usually, charger plates are left on the table as large coasters for soup, salad, appetizer, etc.

Although charger plates improve aesthetic values, they nevertheless are limited to their fixed aesthetic and decorative features. For example, charger plates are incapable of being dynamically adapted and configured to color schemes, lightings, ambience, types of food, etc.

SUMMARY

Accordingly, a need has arisen for providing decorative charger plates enabled with illuminating members. In one embodiment, illuminated charger plates are configurable to emit light where the light color and brightness are user adjustable. Accordingly, the color and the brightness of an illuminated charger plate are user selectable, e.g., based on the desired ambience, desired event type, desired food type, desired color scheme, etc. The illuminated charger plates transform each food serving into an aesthetically pleasing focal point and a center piece. It will become apparent to those skilled in the art after reading the detailed description of the present invention that the embodiments of the present invention satisfy the above mentioned needs.

In one embodiment of the present invention, a charger plate includes a base portion that is substantially at a center of the charger plate. The charger plate further includes a raised portion that circumferentially surrounds the base portion. The charger plate further includes a circuit that can drive illuminated members of the charger plate.

According to one embodiment, the base comprises a transparent portion, e.g., glass. The base may further include one or more light emitting diodes (LEDs), for instance, that is operable to emit light from the transparent portion of the base. In one embodiment, the base includes a reflective portion that is operable to reflect light emitted from the LEDs. The base may further include a light pipe for distributing light emitted from the LEDs to various portions of the base. It is appreciated that the base may also include an opaque portion, e.g., substantially adjacent to the transparent portion, for housing the circuit and other electronic components. The opaque portion of the base can be used to hide the electronic components from plain view. It is appreciated that other light sources, aside from LEDs, can also be used. For example, small incandescent tubes, light fibers, etc., may also be used.

It is appreciated that in one embodiment, the raised portion is substantially opaque. Thus, the circuit and other electronic components can be placed under the raised portion in order to hide the circuit and other electronic components from plain view when the charger plate is placed on a table.

The circuit is operable to control the operation of one or more LEDs independently. The circuit may control the color and/or the brightness of the light being emitted from each LED. Furthermore, the circuit may control the timing and the sequence of LEDs being turned on/off. Thus, the circuit may change the color and the brightness of the light being emitted from each LED dynamically over time and it may turn each of the LEDs on/off in a desired sequence to be visually appealing.

According to one embodiment, the circuit does not house the battery on or within the charger plate. The power source may be external. For example, magnetic strips may be placed on the table along with a battery or power source that is separate from the charger plate. The circuit is then powered via inductive magnets. As a result, the circuit becomes smaller, thereby making it easier to hide from plain view. However, it is appreciated that the circuit may house a battery or the battery may be disposed within the charger plate.

In one embodiment, the charger plate includes a rim. The rim circumferentially surrounds the raised portion and may include one or more LEDs. In one embodiment, the rim includes a light pipe that distributes light emitted from the LEDs housed within the rim. It is appreciated that the operation of the LEDs within the rim is controlled by the circuit. According to one embodiment, the rim includes a transparent portion, e.g., glass, for enabling light output from the LEDs housed therein.

It is appreciated that the LEDs of the rim are powered by the circuit. For example, a wire along the raised portion may be used to power the LEDs on the rim. The wire may be hidden from plain view by placing it underneath the raised portion. In one embodiment, however, the wire may be place within a channel that runs within the raised portion. As a result, the wire is hidden from plain view and enhances the visual appearance of the charger plate.

In accordance with various embodiments of the present invention, the illuminated members of the charger plate act to increase the overall decorative nature of a table place-setting, e.g., for a dining event, etc.

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details. In other instances, well known methods, procedures, components, and circuits have not been described in detail as not to unnecessarily obscure aspects of the invention.

Figure 1A:
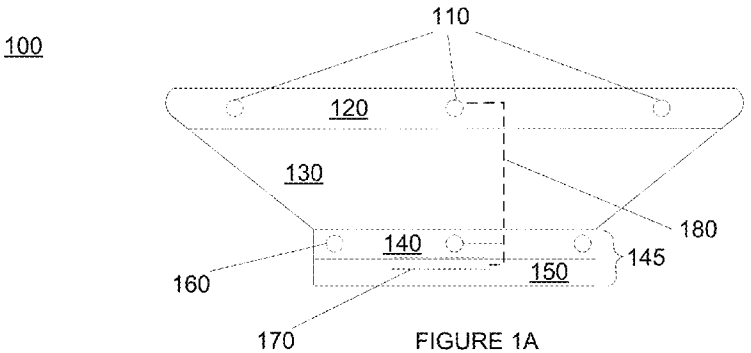
FIGS. 1A and 1B show a side view and a top view of a charger plate in accordance with one embodiment of the present invention.
Figure 1B:
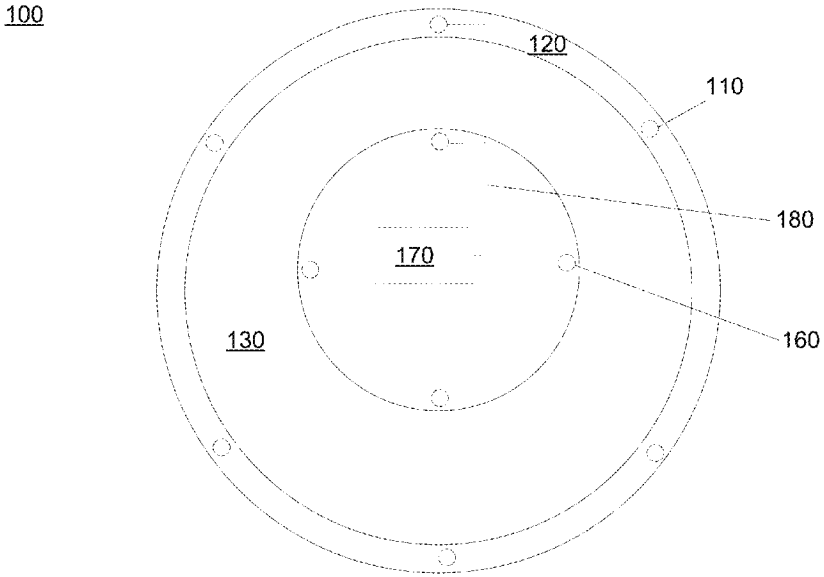

Referring now to FIGS. 1A and 1B, a side view and a top view of a charger plate 100 in accordance with one embodiment of the present invention are shown. The charger plate 100 includes a base 145, a raised portion 130, and a rim 120. The base 145 is substantially located at the center of the charger plate 100.

According to one embodiment, the base 145 includes an opaque portion 150 and a transparent portion 140 that may act as a light pipe. The opaque portion 150 may be made of glass, plastic, ceramic, melamine resin, stone, etc. The transparent portion 140 may be made of any transparent material, e.g., clear glass or colored glass that is still transparent.

In one embodiment, the opaque portion 150 may house a circuit 170 that controls one or more light sources, e.g., light emitting diodes (LEDs) 160. It is appreciated that other light sources, aside from LEDs, can also be used. For example, small incandescent tubes, light fibers, etc., may also be used. It is appreciated that the use of LEDs throughout this application is exemplary and not intended to limit the scope of the present invention. Placing the circuit 170 within the opaque portion 150 substantially hides the circuit 170 from plain view, thereby maintaining the visual appeal of the charger plate 100.

In one exemplary embodiment, the LEDs 160 are placed in the transparent portion 140 for outputting light there through. It is appreciated that the transparent portion 140 may further include a layer of reflective material disposed underneath for reflecting light emitted from the LEDs 160. In one embodiment, the reflective material layer may be deposited over the opaque portion 150 between layers 150 and 140.

The circuit 170 is operable to control the operation of each of the LEDs 160 independently. According to one embodiment, the circuit 170 controls the color of the light being emitted by the LEDs 160. Moreover, the circuit 170 is operable to control the brightness of the light being emitted from each LED. In one exemplary embodiment, the circuit 170 may have a timing component that is operable to control the sequence of which each LED is turned on/off and the amount of time which each LED remains on/off.

In other words, the light output from the LEDs 160 may be configured, e.g., light sequencing, light colors, light brightness, timing or any combination thereof. As such, sequencing the on/off state of the LEDs 160, their respective colors and their brightness over time may appear as an animation. Any combination of LED colors with different or the same brightness may be turned on/off to appear as an animation. For example, different colors of light output may snake around the base 145 in sequence. In one embodiment, the same color of light may snake around the base 145. Other embodiments may employ different brightness values as the light output varies in illumination around the base 145. In one exemplary embodiment, the light output is turned on sequentially and kept on until the last LED is turned on before the first LED that was turned on changes color, brightness, or turned off, etc. Accordingly, a sequence of specific LEDs may be selected, their colors may be configured, their brightness may be adjusted and their timing may be altered all dynamically based on user preferences.

It is appreciated that wire 180 may couple the circuit 170 to each LED. It is noted that only one connection from the circuit 170 to the LED 160 is shown not to obscure the figure.

According to one embodiment, the raised portion 130 may be opaque. For example, the raised portion 130 may comprise glass, plastic, ceramic, melamine resin, stone, etc.

According to one embodiment, the rim 120 includes a plurality of LEDs 110. The rim 120 includes a transparent portion, e.g., a light pipe, to enable light output from the LEDs 110 to pass there through. According to one embodiment, the transparent portion may include any transparent material, e.g., clear glass, colored glass that is still transparent, light pipe material, etc. The wire 180 couples each LED to the circuit 170. It is appreciated that the circuit 170 is operable to control each LED of the plurality of LEDs 110 independently in a similar fashion to LEDs 160.

According to one embodiment, the wire 180 may be routed underneath the raised portion 130 that is opaque. Thus, the wire 180 is substantially hidden from plain view. In an alternative embodiment, the wire 180 may be placed within a channel that is integrated within the raised portion 130, thereby hiding the wire 180 from plain view.

Figure 1C:
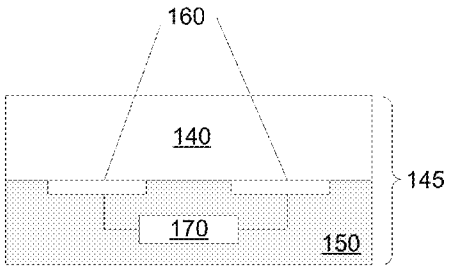
FIG. 1C shows a side view of a base portion of a charger plate in accordance with one embodiment of the present invention.

Referring now to FIG. 1C, a side view of a base portion 145 of a charger plate in accordance with one embodiment of the present invention is shown. The base 145 includes the transparent 140 portion and the opaque 150 portion. In this embodiment, the LEDs 160 may be placed within the opaque 150 portion but flushed to the transparent 140 portion for emitting light. The circuit 170 is placed within the opaque portion, thereby hiding the circuit 170 from plain view. As such, the site of circuitry, wires and electronic components are hidden from plain view.

It is appreciated that the number of LEDs in each portion may vary depending on the design. As such, the number of LEDs shown is exemplary and not intended to limit the scope of the present invention.

Figure 2A:
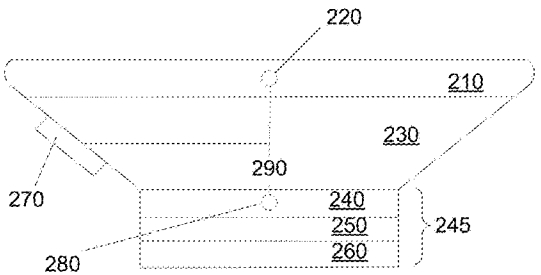
FIGS. 2A and 2B show a side view and a top view of a charger plate in accordance with another embodiment of the present invention.
Figure 2B:
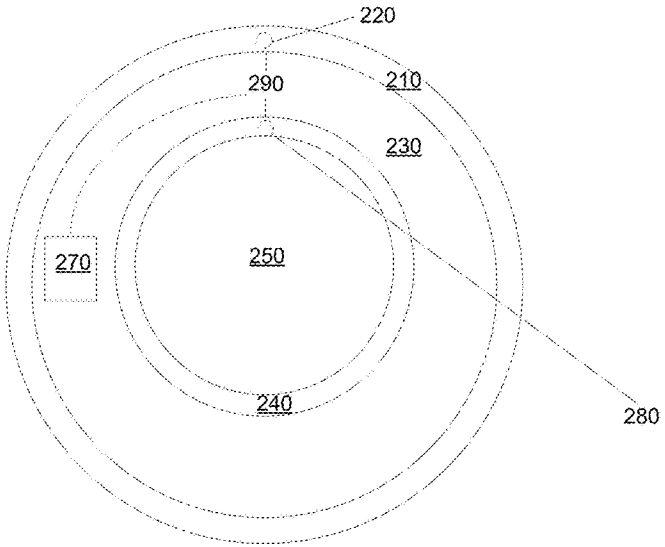

Referring now to FIGS. 2A and 2B, a side view and a top view of a charger plate 200 in accordance with another embodiment of the present invention are shown. The charger plate includes a base 245, a raised portion 230, and a rim 210. The base 245 is substantially at the center of the charger plate.

According to one embodiment, the base 245 includes an opaque portion 260, a reflective portion 250, and a light pipe 240. The light pipe 240 and the reflective portion 250 form a transparent portion. The opaque portion 260 may be made of glass, plastic, ceramic, melamine resin, stone, etc. The reflective portion 250 operates substantially similar to that discussed above with respect to FIGS. 1A-1C. The light pipe 240 is operable to distribute light from a light source, e.g., LED 280, within the base 245 to another point within the base 245. The light pipe 240 may be a fiber optic line in one embodiment.

In this embodiment, the raised portion 230 is opaque similar to the raised portion 130. A circuit 270 may be placed underneath the raised portion 230 in order to hide the circuit 270 from plain view. As such, the visual appeal of the charger plate is maintained. It is appreciated that the circuit 270 may be placed in the opaque portion 260 instead in order to substantially hide the circuit 270 from plain view.

The circuit 270 controls one or more light sources, e.g., LEDs 280 and 220. The operation of the circuit 270 is substantially similar to that of FIGS. 1A-1C. The circuit 270 is coupled to the LEDs 280 and 220 via wireline 290 similar to that of FIGS. 1A-1C. It is appreciated that the wireline 290 may be routed underneath the raised portion 230 that is opaque in order to hide the wire from plain view. Alternatively, a channel within the raised portion 230 may be used to hide the wirelines 290.

The rim 210 includes the LED 220 and is substantially similar to the rim 120, as discussed above. In this embodiment, the rim 210 comprises a light pipe. It is appreciated that the number of LEDs shown is exemplary and not intended to limit the scope of the present invention.

Figure 3A:
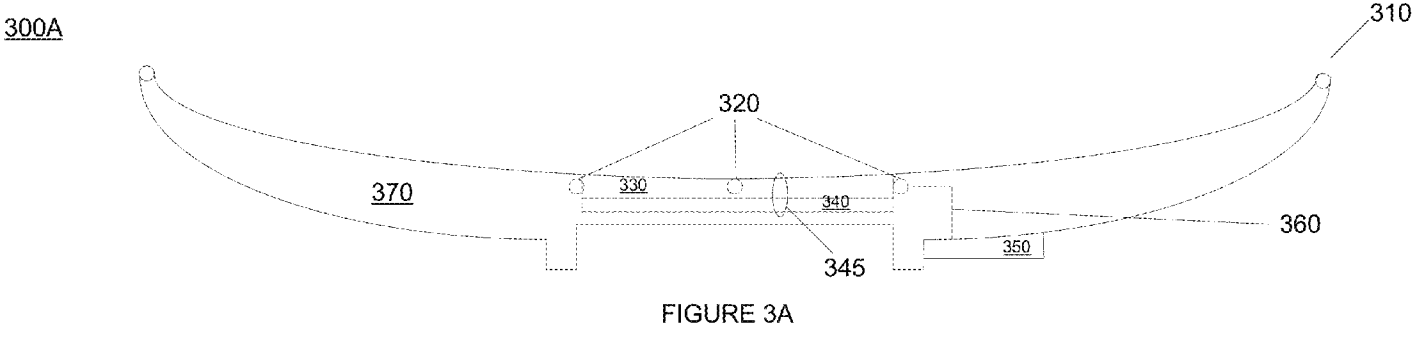
FIGS. 3A, 3B, and 3C show a side view of charger plates in accordance with embodiments of the present invention.
Figure 3B:
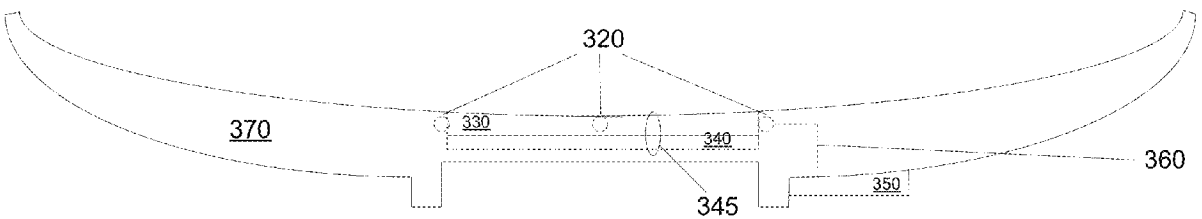
Figure 3C:
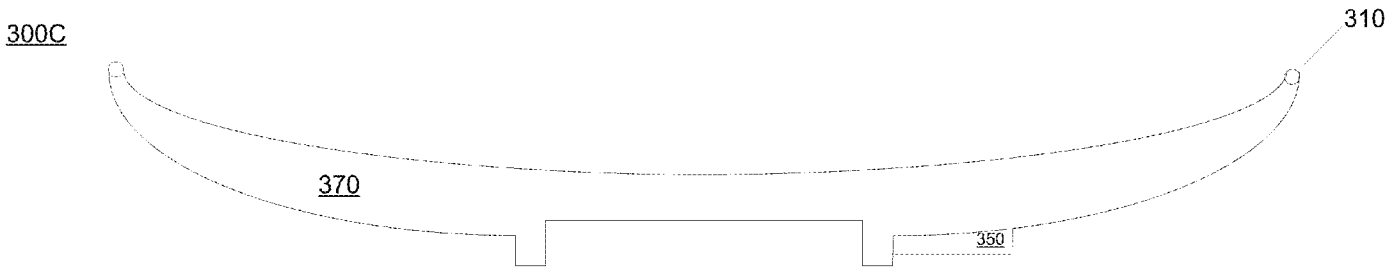

Referring now to FIGS. 3A, 3B, and 3C, a side view of charger plates in accordance with embodiments of the present invention are shown. A charger plate 300A may include a base portion 345 and an opaque portion 370. The base 345 is substantially in the center of the charger plate 300A and may include a reflective portion 340 and a transparent portion 330. The reflective portion 340 and the transparent portion 330 are substantially similar to that of FIGS. 1A-1C and FIGS. 2A-2B. The opaque 370 portion is substantially similar to the raised portion of the charger plates described in FIGS. 1A-1C and FIGS. 2A-2B.

In this embodiment, the opaque 370 portion houses the base light sources, e.g., LEDs 320, that are flush against the transparent portion 330 for outputting light. The base LEDs 320 are coupled to a circuit 350 via a wireline 360. The circuit 350 operates substantially similar to that of FIGS. 1A-1C. The circuit 350 is placed under the opaque 370 portion in order to substantially hide the circuit 350 from plain view. Moreover, the wireline 360 is routed under the opaque 370 portion or through a channel within the opaque 370 portion in order to hide the wireline 360 from plain view.

The charger plate 300A further includes a rim that houses LEDs 310. The LEDs 310 are coupled to the circuit 350 and operate substantially similar to the LEDs of the rim in FIGS. 1A-1C. The LEDs 310 are powered via a wireline under the opaque 370 portion or through a channel within the opaque 370 portion (not shown).

It is appreciated that the circuit 350 may be placed in a different location within the charger plate 300A in order to be substantially hidden from plain view. For example, the circuit 350 may be placed underneath the opaque 370 portion that is substantially underneath the base 345. Thus, the location of the circuit 350 is exemplary and not intended to limit the scope of the present invention. It is further appreciated that the number of LEDs shown are exemplary and not intended to limit the scope of the present invention. It is also appreciated that the use of the reflective portion 340 is exemplary and not intended to limit the scope of the present invention. For example, the transparent portion 330 may be used alone without using the reflective portion 340.

Referring now to FIG. 3B, a charger plate 300B is shown. The charger plate 300B is substantially similar to that of FIG. 3A except that the rim of the charger plate 300B does not include any LEDs in this embodiment.

Referring now to FIG. 3C, a charger plate 300C is shown. The charger plate 300C is substantially similar to that of FIG. 3A except that in this embodiment, the charger plate 300C does not include the illuminated base 345 portion.

Figure 4B:
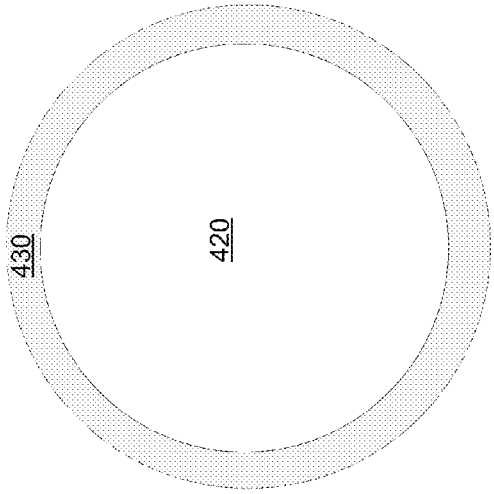
FIGS. 4A, 4B, and 4C show visual appearance of LED enabled charger plates in accordance with embodiments of the present invention.
Figure 4A:
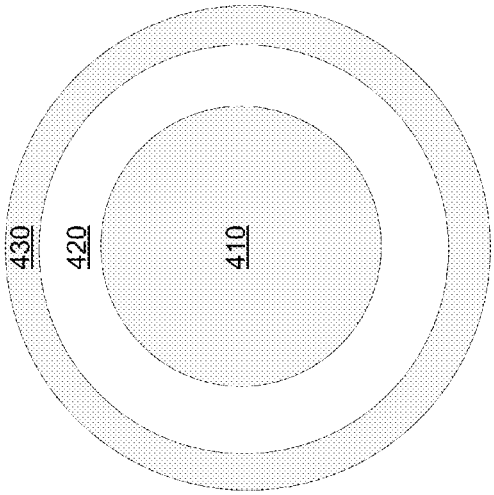
Figure 4C:
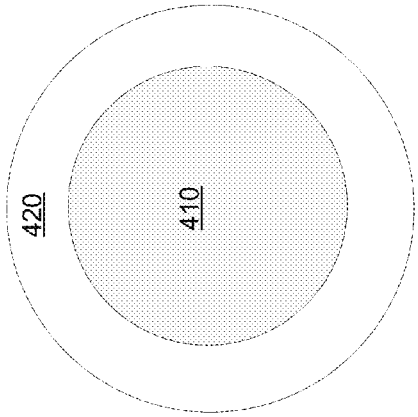

Referring now to FIGS. 4A, 4B, and 4C, visual appearance of illuminated charger plates in accordance with embodiments of the present invention are shown. FIG. 4A shows a base 410 and a rim 430 of a charger plate being lit while the raised portion 420 is opaque and does not emit light. FIG. 4B shows a charger plate without an LED enabled base. For example, the center 420 of the charger plate is opaque and does not emit light while the rim 430 emits light. FIG. 4C shows a charger plate where the base 410 is lit and the rim 420 is not.

Figure 5:
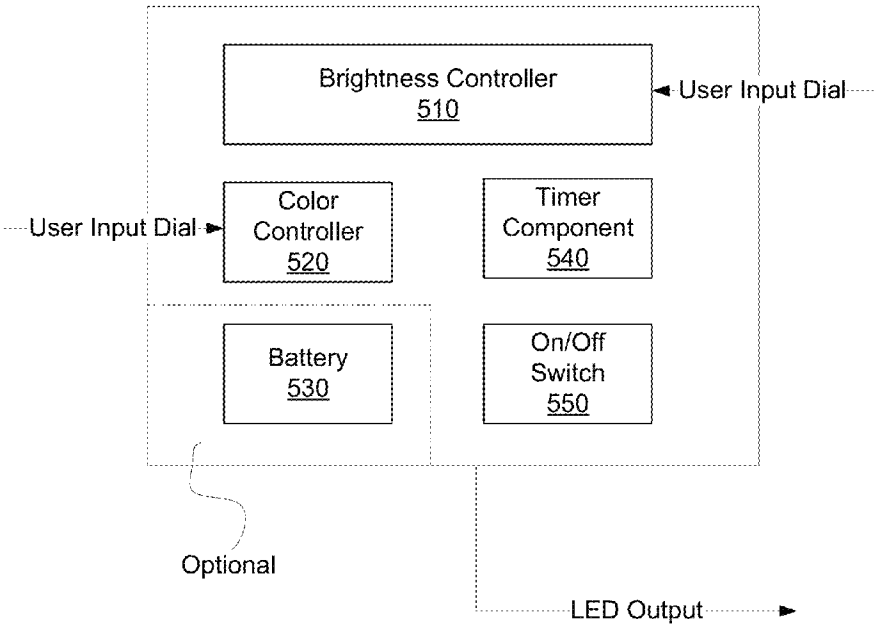
FIG. 5 shows a circuit of a charger plate in accordance with one embodiment of the present invention.

Referring now to FIG. 5, a circuit 500 of a charger plate in accordance with one embodiment of the present invention is shown. The circuit 500 includes a brightness controller 510, a color controller 520, an optional battery 530, a timer component 540, and an on/off switch 550.

The brightness controller 510 is operable to control the brightness of light being output from each of the LEDs of the charger plate. For example, the brightness may be controlled via one or more user input dials. The color controller 520 is operable to control the color of the light being output from each of the LEDs, e.g., via one or more user input dials. The battery 530 provides the operating power for the circuit 500 and the LEDs on the charger plate. The timer component 540 controls the timing for turning each of the LEDs on/off. The on/off switch 550 is operable to turn the circuit on or off.

Each LED may be independently controlled. Moreover, the light output from the LEDs may be configured, e.g., light sequencing, light colors, light brightness, timing or any combination thereof. As such, sequencing the on/off state of the LEDs, their respective colors and their brightness over time may appear as an animation. Any combination of LED colors with a different or the same brightness may be turned on/off to appear as an animation. For example, different colors of light output may snake around the base and/or the rim. In one embodiment, the same color of light may snake around the base and/or the rim. Other embodiments may employ different brightness values as the light output snakes around the base and/or the rim. In one exemplary embodiment, the light output is turned on sequentially and kept on until the last LED is turned on before the first LED that was turned on changes color, brightness, or turned off, etc.

Accordingly, a sequence of specific LEDs may be selected, their colors may be configured, their brightness may be adjusted and their timing may be altered based on user preferences. Thus, the charger plate is dynamically configurable based on user's preference, event, type of food, ambience, color scheme, food type, etc.

Figure 6:
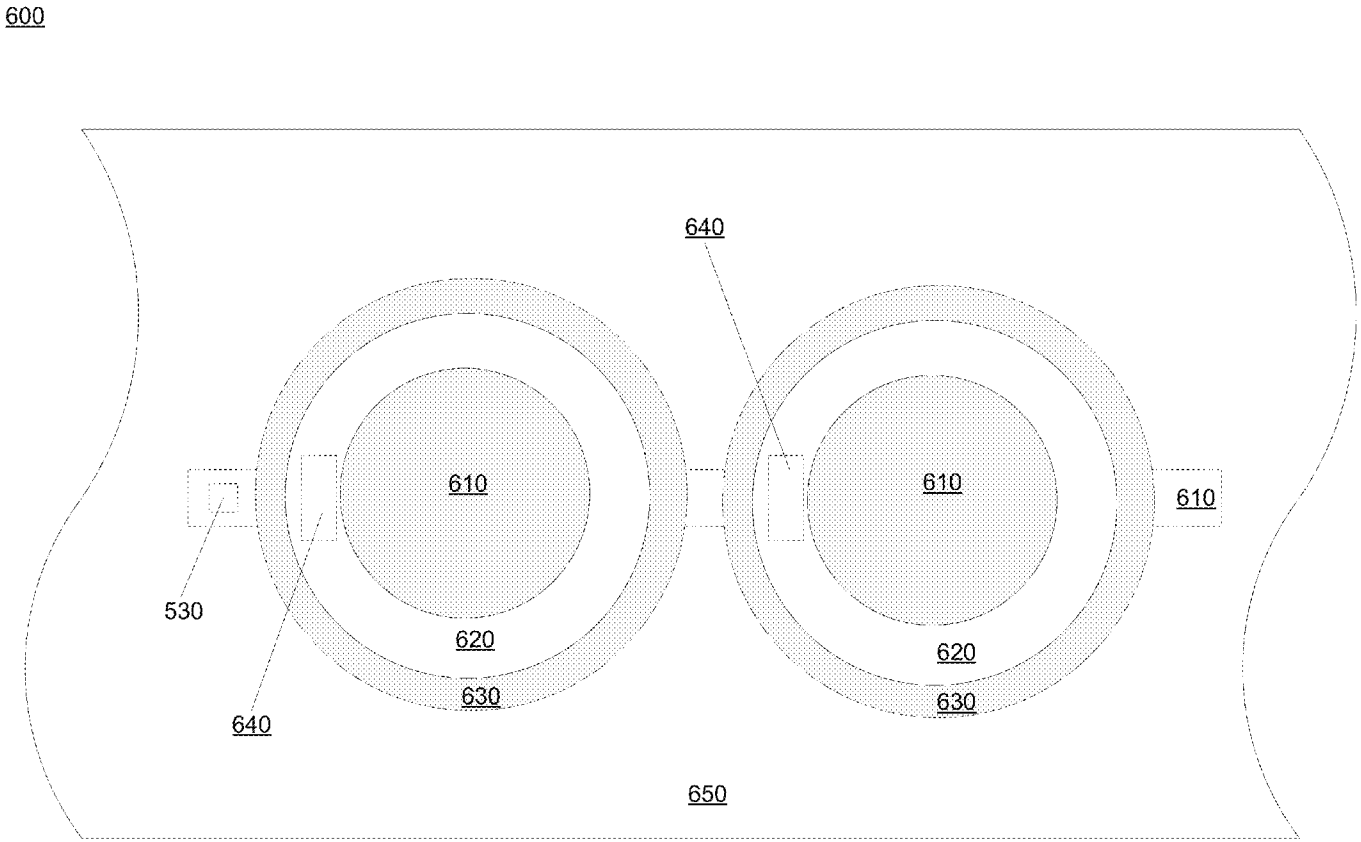
FIG. 6 shows a system for using charger plates without a use of a battery in the charger plates in accordance with embodiments of the present invention.

Referring now to FIG. 6, a system 600 for using charger plates without use of an internal battery on the charger plate in accordance with embodiments of the present invention is shown. The system includes two or more charger plates with an LED enabled base 610, a raised portion 620, and an LED enabled rim 630. The raised portion 620 is opaque in this embodiment. Each charger plate includes a circuit 640 that operates substantially similar to that of FIGS. 1A-1C and FIG. 5. However, the circuit 640 does not house the battery on the circuit 640 or within the charger plate. The circuit 640 is powered using a magnetic strip 610 placed under or near the plates and the battery or other power source 530 housed separate from the circuit 640 and the charger plates. For example, the battery or power source 530 may be placed somewhere on or near the table. The table may be covered with table cloth 650 in order to hide the magnetic strip 610 and the battery 530 from plain view. The circuit 640 is powered using inductive magnetic fields. As a result, the circuit 640 becomes smaller and less bulky. Therefore, the circuit 640 may be hidden from plain view more easily. Accordingly, aesthetic features of a charger plate are maintained.

It is appreciated that more than one magnetic strip 610 may be used. Thus, the number of magnetic strips shown is exemplary and not intended to limit the scope of the present invention. For example, four magnetic strips may be used. The magnetic strip may take any shape, e.g., square, circle, strip, etc.

Accordingly, the illuminated charger plates may be user configurable by controlling the color, brightness, their timing, sequencing, etc. being emitted from the LEDs on the charger plate. Thus, LED enabled charger plates transform each food serving into an aesthetically pleasing focal point and a center piece.

In the foregoing specification, embodiments of the invention have been described with reference to numerous specific details that may vary from implementation to implementation. Thus, the sole and exclusive indicator of what is, and is intended by the applicants to be, the invention is the set of claims that issue from this application, in the specific form in which such claims issue, including any subsequent correction. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A dining plate comprising:

a base portion positioned substantially at a center of said plate, wherein said base portion comprises a first light emitting element operable to output light from said base portion and a light pipe operable to distribute light emitted from said first light emitting element to a destination position on said base portion;

a raised portion circumferentially surrounding said base portion, wherein said raised portion is substantially opaque; and a circuit operable to control an operation of said first light emitting element.

2. The plate as described in claim 1, wherein said base portion comprises a reflective portion operable to reflect light from said first light emitting element.

3. The plate as described in claim 1, wherein said circuit is positioned such that said circuit is substantially hidden from plain view.

4. The plate as described in claim 1, wherein said first light emitting element is a light emitting diode (LED), and wherein further circuit is operable to control a timing associated with said first LED.

5. The plate as described in claim 4 further comprising:

a second LED operable to output light from said base portion, and wherein said circuit is operable to independently control operation of said first LED and said second LED.

6. The plate as described in claim 1, wherein said circuit is operable to receive operating power via power inductive magnets positioned at close proximity to said circuit that are powered by a power source, wherein said power source is separate from said plate.

7. The plate as described in claim 1, wherein said circuit is operable to control a color and further control a brightness of said first light emitting element.

8. A charger plate comprising:

a base portion positioned substantially at a center of said charger plate, wherein said base portion comprises a first light emitting diode (LED) operable to output light from said base portion;

a raised portion circumferentially surrounding said base portion, wherein said raised portion is substantially opaque;

a rim circumferentially surrounding said raised portion, wherein said rim comprises a second LED operable to output light from said rim; and a circuit operable to independently control an operation associated with said first LED and said second LED.

9. The charger plate as described in claim 8, wherein said base portion comprises a reflective portion operable to reflect light from said first LED.

10. The charger plate as described in claim 8, wherein said circuit is positioned such that said circuit is substantially hidden from plain view.

11. The charger plate as described in claim 8, wherein said base portion comprises a light pipe operable to distribute light emitted from said first LED.

12. The charger plate as described in claim 8, wherein said rim comprises a light pipe operable to distribute light emitted from said second LED.

13. The charger plate as described in claim 8, wherein said circuit is operable to independently control a color, a brightness, and a timing associated with said first LED and said second LED according to user selectable settings.

14. The charger plate as described in claim 8 further comprising:

a third LED operable to output light from said base portion; and a fourth LED operable to output light from said rim;

wherein said circuit is operable to independently control operation of said third LED and said fourth LED.

15. The charger plate as described in claim 8, wherein said circuit is operable to receive operating power via power inductive magnets positioned at close proximity to said circuit that are powered by a power source, wherein said power source is separate from said charger plate.

16. A charger plate comprising:

a base portion positioned substantially at a center of said charger plate, wherein said base portion comprises a first plurality of light sources operable to output light from said base portion;

a raised portion circumferentially surrounding said base portion, wherein said raised portion is substantially opaque;

a rim circumferentially surrounding said raised portion, wherein said rim comprises a second plurality of light sources operable to output light from said rim; and a circuit operable to independently control a color and a brightness associated with said first plurality of light sources and said second plurality of light sources.

17. The charger plate as described in claim 16, wherein said circuit comprises a battery.

18. The charger plate as described in claim 16, wherein said base portion comprises a reflective portion operable to reflect light from said first plurality of light sources.

19. The charger plate as described in claim 16, wherein said base portion comprises a light pipe operable to distribute light emitted from said first plurality of light sources to a destination position of said base portion, and wherein said rim comprises a light pipe operable to distribute light emitted from said second plurality of light sources to a destination position of said rim.

20. The charger plate as described in claim 16, wherein said circuit is operable to receive operating power via power inductive magnets positioned at close proximity to said circuit that are powered by a power source, wherein said power source is separate from said charger plate.

* * * * *